US006814016B2

(12) United States Patent
Hori

(10) Patent No.: US 6,814,016 B2
(45) Date of Patent: Nov. 9, 2004

(54) SEWING MACHINE

(75) Inventor: Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/395,390

(22) Filed: Mar. 25, 2003

(65) Prior Publication Data

US 2003/0183144 A1 Oct. 2, 2003

(30) Foreign Application Priority Data

Mar. 28, 2002 (JP) ..... 2002-091561

(51) Int. Cl.[7] ..... D05B 87/02
(52) U.S. Cl. ..... 112/225
(58) Field of Search ..... 223/99; 112/475.01, 112/475.17, 221, 224, 225

(56) References Cited

U.S. PATENT DOCUMENTS 4,651,660 A * 3/1987 Oshima et al. ..... 112/225
5,003,900 A * 4/1991 Ogawa ..... 112/242
6,067,919 A * 5/2000 Shoji ..... 112/225
6,564,731 B2 * 5/2003 Sano et al. ..... 112/225

FOREIGN PATENT DOCUMENTS

JP B2 7-71596 8/1995

* cited by examiner

*Primary Examiner*—Ismael Izaguirre
(74) *Attorney, Agent, or Firm*—Oliff & Berridge, PLC

(57) ABSTRACT

A sewing machine includes an actuator moving a threading hook downward so that the threading hook is passed through an eye of a needle, a transmitter moved between a transmission position where an operation of the actuator is transmitted to the threading hook and a non-transmission position where an operation of the actuator is not transmitted to the threading hook, a thread holder holding the thread, a moving mechanism for moving the thread holder near to a position where the thread held by the thread holder is located near the threading hook having been passed through the needle eye, and an abutment abutting the transmitter when the thread holder has been moved to the position of the thread to move the transmitter from the transmission position to the non-transmission position.

9 Claims, 19 Drawing Sheets

SEWING MACHINE

BACKGROUND OF THE INVENTION

1. Field of the Invention

This invention relates generally to sewing machines and more particularly to sewing machines provided with a threading hook which passes a thread through a needle eye.

2. Description of the Related Art

Conventional sewing machines comprise a threading apparatus including a threading hook coming close to and going away from a needle eye, a threading bar for supporting the hook, a threading lever joined with the threading bar, a holding member for holding a sewing thread at two locations, and a moving mechanism for moving the holding member near the needle eye. The threading apparatus is disposed above a movement range of the needle so as to be prevented from collision with the needle. In the foregoing threading apparatus, the threading lever is operated vertically so that the threading bar is moved downward together therewith. When the threading lever is moved downward to a lowermost position thereof, the threading hook is at the same level as the needle eye, so that the thread held by the holding member near the needle eye is passed through the needle eye.

Furthermore, conventional sewing machines comprise a swinging mechanism for swinging the sewing needle horizontally. The needle swung by the swinging mechanism forms a generally arcuate swinging locus. In such conventional sewing machines, the position of the needle eye differs depending upon a swinging location of the needle. In these conventional sewing machines, the threading bar and holding member are swung horizontally together with the needle bar for the purpose of reducing an adverse effect of the changes in the position of needle eye depending upon the swinging location of the needle. For example, JP-B-7-71596 discloses such a construction.

However, in the disclosed sewing machine, the threading lever is pressed down to a lowermost position and stopped once, and thereafter, the lever is released from the pressing operation before the threading operation is completed.

SUMMARY OF THE INVENTION

Therefore, an object of the present invention is to provide a sewing machine in which the thread can reliably be passed through the needle eye irrespective of the vertical position of the needle.

The present invention provides a sewing machine comprising a sewing needle moved up and down and having an eye, a threading hook passed through the eye of the needle, an urging member for urging the threading hook upward, an actuating member for moving the threading hook downward against an urging force of the urging member so that the threading hook is passed through the needle eye, a transmitting member moved between a transmission position where an operation of the actuating member is transmitted to the threading hook and a non-transmission position where an operation of the actuating member is not transmitted to the threading hook, a thread holding member for holding a thread, a moving mechanism for moving the thread holding member near to a position where the thread held by the thread holding member is located near the threading hook having been passed through the eye of the needle, and an abutting member abutting the transmitting member when the thread holding member has been moved to the position where the thread held by thread holding member is located near the threading hook having been passed through the eye of the needle, in order to move the transmitting member from the transmission position to the non-transmission position.

The operation of the actuating member is transmitted via the transmitting member to the threading hook upon operation of the actuating member. As a result, the threading hook is moved downward to be advanced through the eye of the needle. Continuously, when the thread holding member is moved by the moving mechanism to the near-by position, the abutting member abuts the transmitting member such that the transmitting member is moved to the non-transmission position. Accordingly, the operation of the actuating member cannot be transmitted to the threading hook. More specifically, the threading hook is returned to a former position after the thread held by the thread holding member has been moved near to the threading hook having been advanced through the eye of the needle. Consequently, the thread can reliably be passed through the eye of the needle.

BRIEF DESCRIPTION OF THE DRAWINGS

Other objects, features and advantages of the present application will become clear upon reviewing the following description of an embodiment, made with reference to the accompanying drawings, in which.

DETAILED DESCRIPTION OF THE INVENTION

Figure 1:
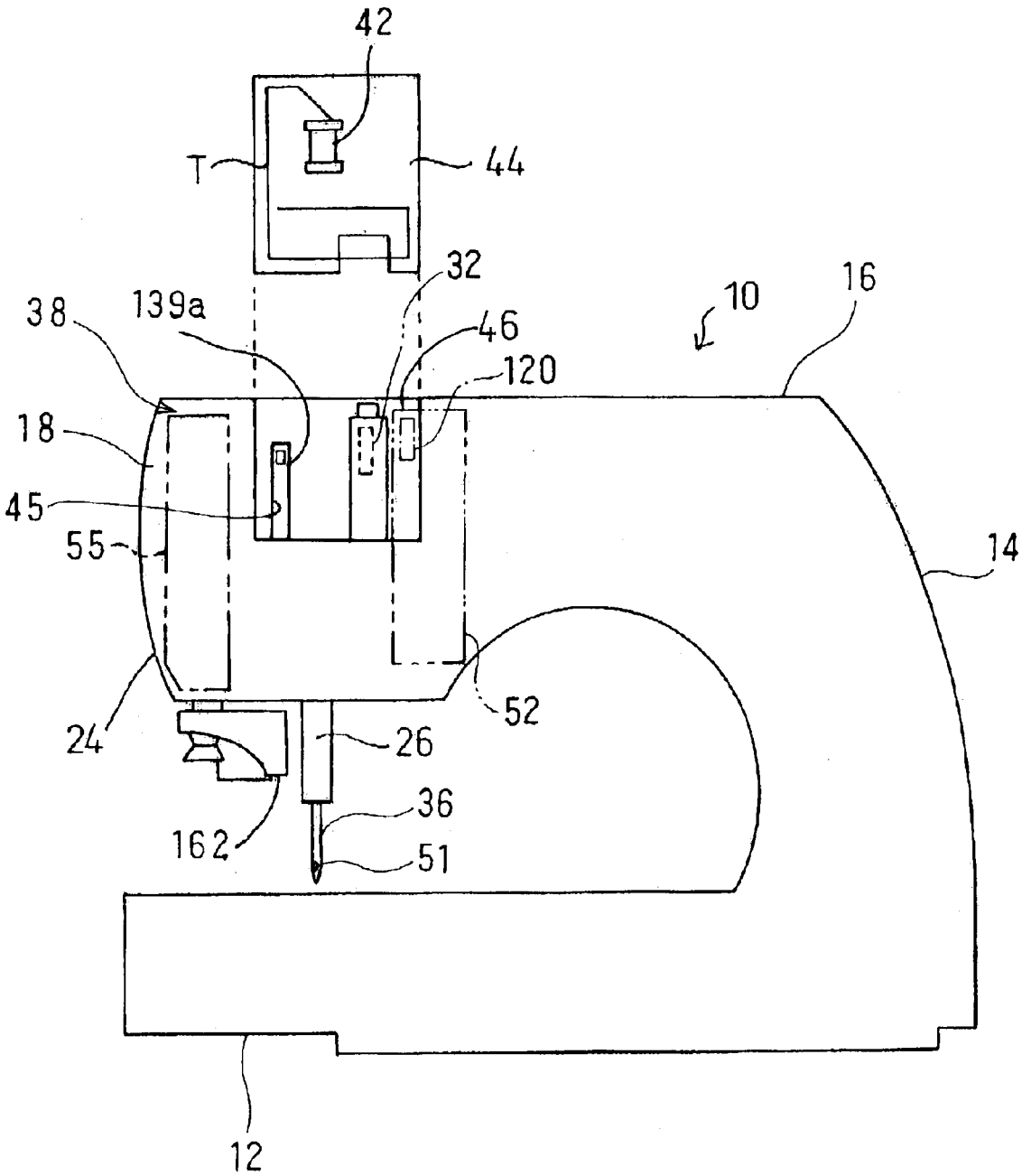
FIG. 1 is a schematic front view of a sewing machine to which the threading apparatus in accordance with the present invention is applied.
Figure 2:
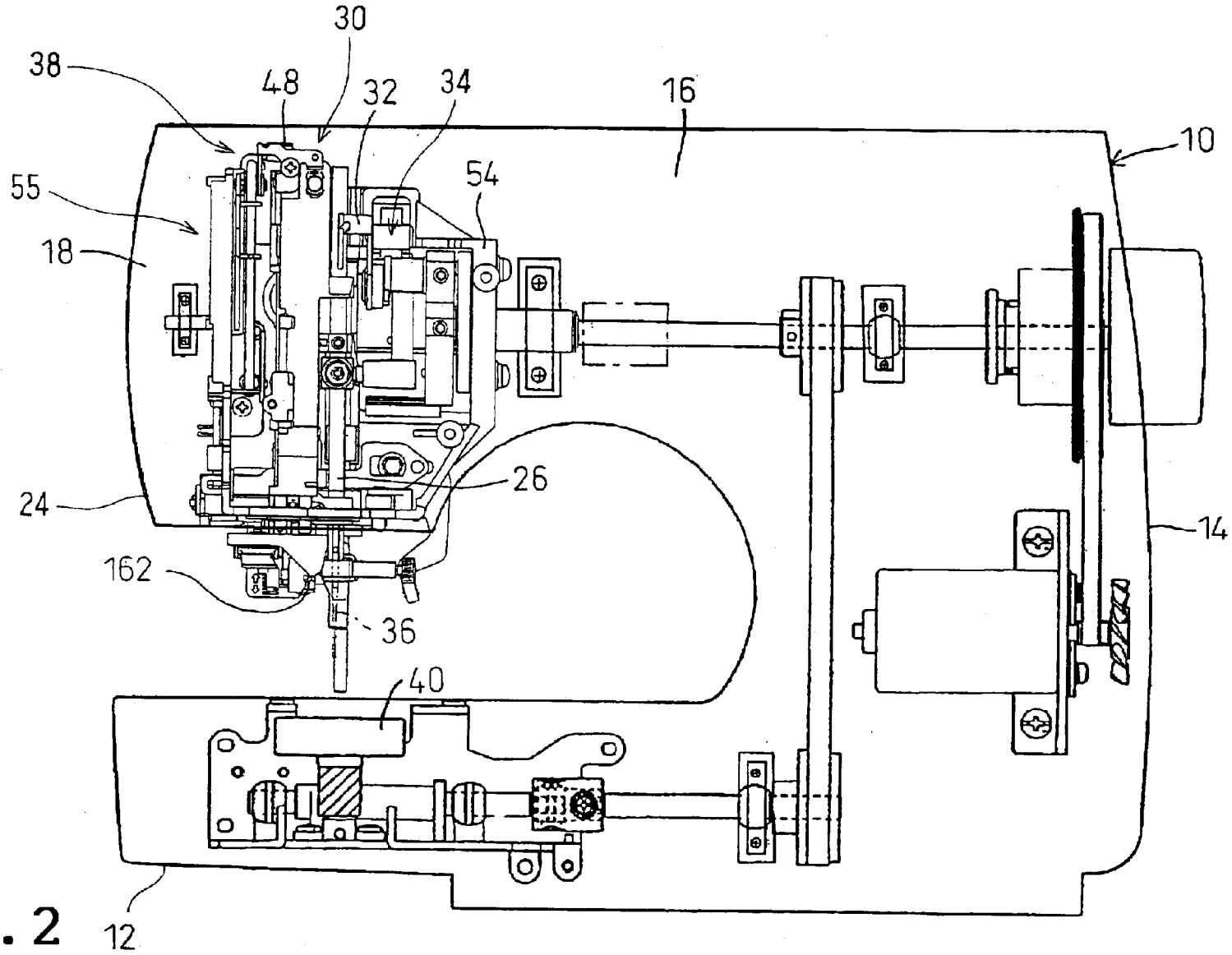
FIG. 2 is a schematic front view of the sewing machine body, showing an inner construction thereof.

One embodiment of the invention will be described with reference to the accompanying drawings. Referring to FIGS. 1 and 2, a sewing machine 10 to which the threading apparatus of the invention is applied is schematically shown. The sewing machine 10 comprises a sewing bed 12 having a horizontal plane, a pillar 14 standing from a right end of the bed 12 and a sewing arm 16 extending rightward from an upper end of the pillar 14 and a machine head 18 located at a left end of the arm 16. A needle bar 26 extends downward from the head 18. A sewing needle 36 is detachably attached to a lower end of the needle bar 26. The head 18 encloses a needle bar driving mechanism 28 for moving the needle bar 26 up and down, a needle bar swinging mechanism 30 for swinging the needle bar 26 horizontally, a needle thread take-up driving mechanism 34 interlocked with the movement of the needle bar driving mechanism 28 for moving the needle thread take-up 32 up and down, and a threading mechanism 38 for passing a needle thread T through the needle 36. A shuttle 40 is provided in the bed 12. Stitches are formed by the needle 36 in cooperation with the shuttle 40.

A cassette attaching portion 46 is provided in the upper front of the head 18 on a sewing machine frame 24. A thread cassette in which a thread spool or bobbin 42 is enclosed is detachably attached to the cassette attaching portion 46. In the sewing machine 10 of the embodiment, the threading mechanism 38 is operated and a needle thread T is hooked on the needle thread take-up 32 when a thread cassette 44 is attached to the cassette attaching portion 46. Japanese Patent Application No. 2001-172264 filed by the same assignee as that of the present application discloses an operation of attaching the thread cassette 44, a threading operation and a thread hooking operation both interlocked with the cassette attaching operation. Differences of the present invention from the aforesaid Japanese patent application will be described.

Figure 3:
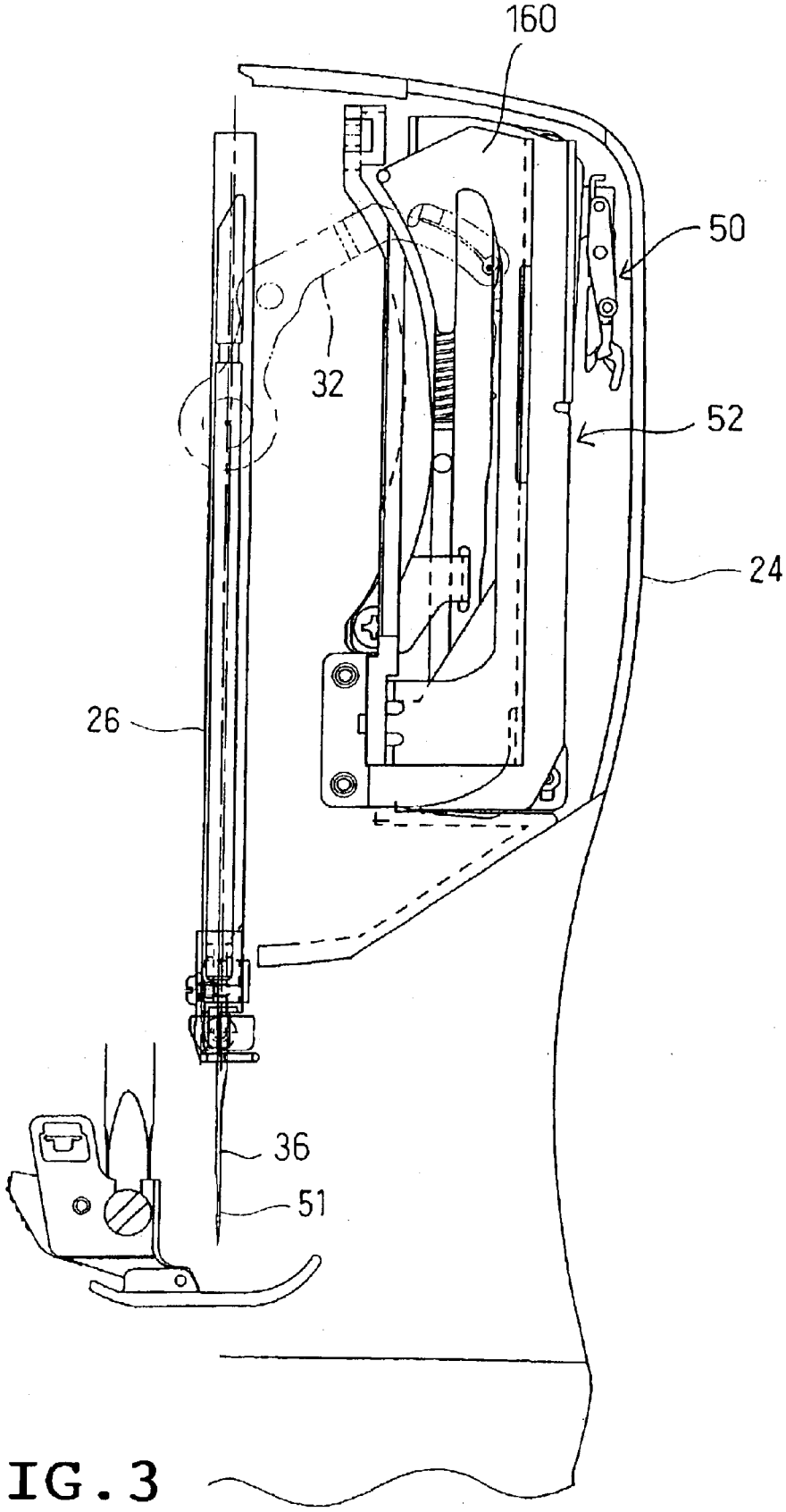
FIG. 3 is a left side view of a thread holding member and a moving mechanism for the thread holding member.
Figure 4:
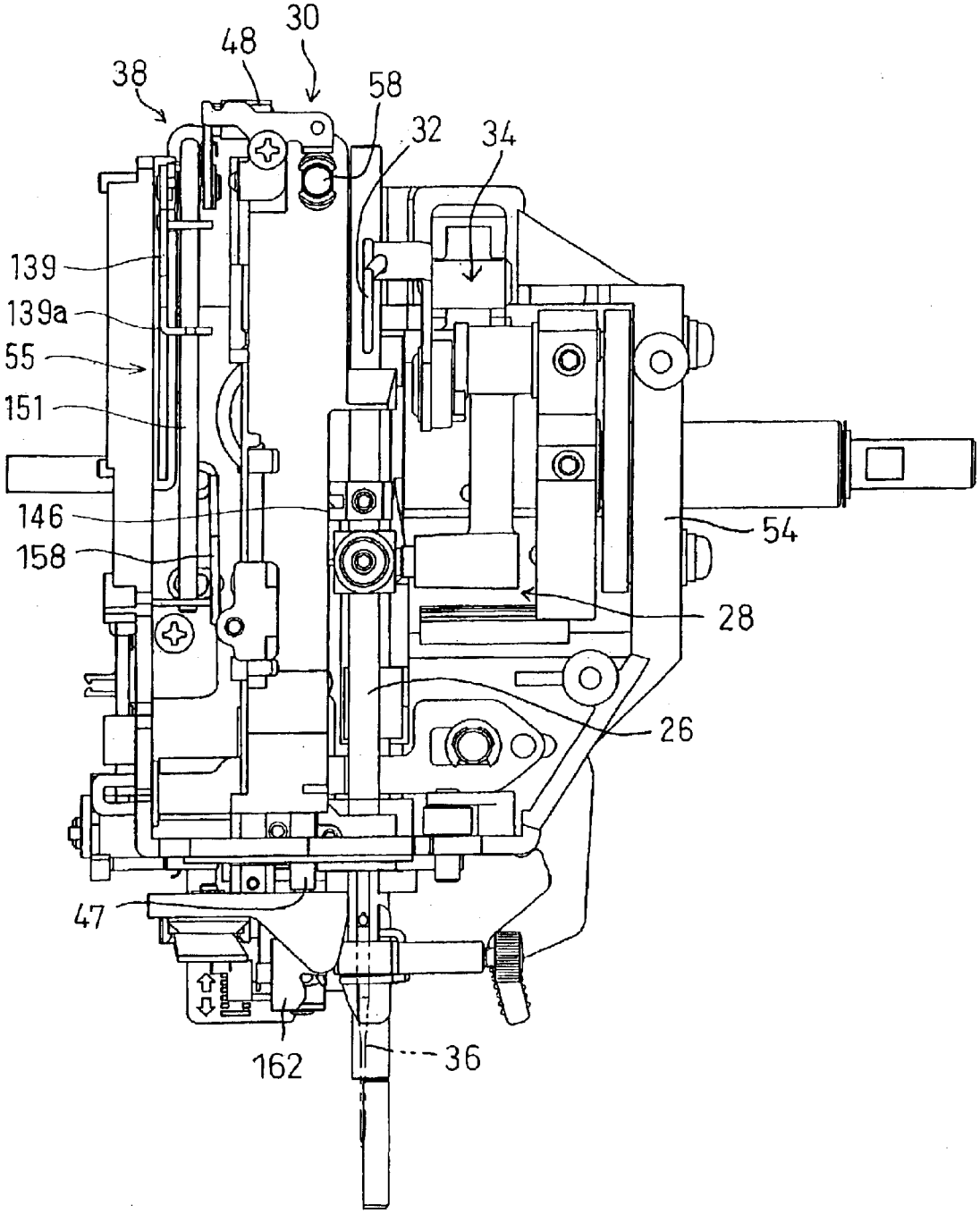
FIG. 4 is an enlarged view of the inner construction of a head of the sewing machine.
Figure 5B:
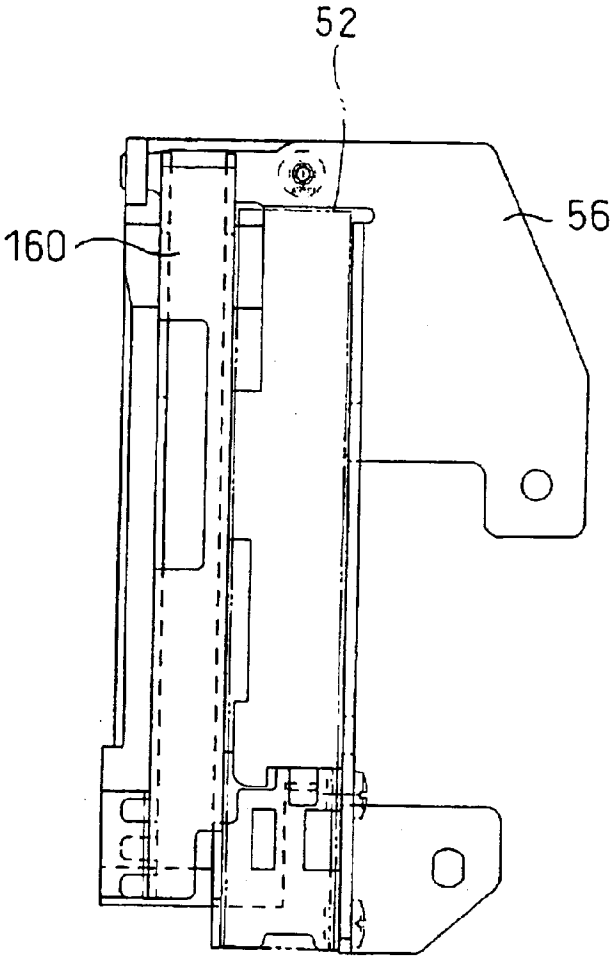
FIG. 5A is a front view of a mounting member and a guide member of a moving mechanism and FIG. 5B shows a positional relation between the guide member and a needle thread take-up.
Figure 5A:
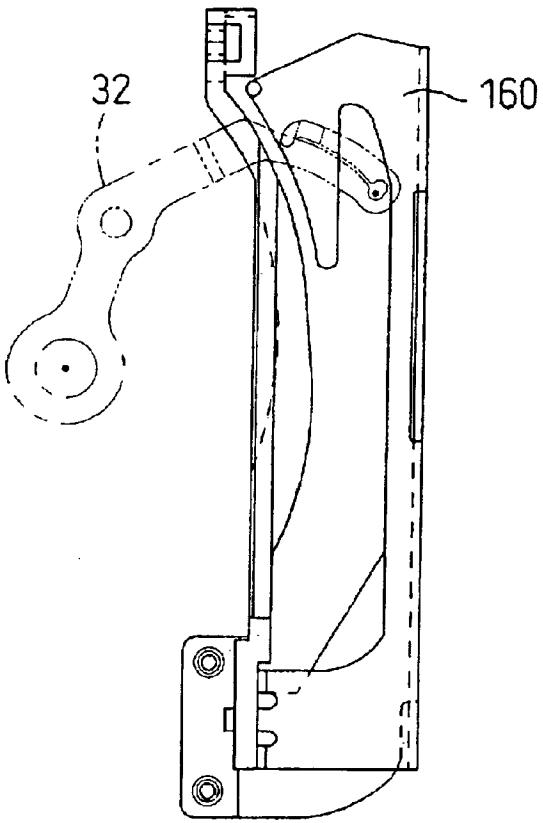

Referring to FIGS. 1 to 3, the threading mechanism 38 is provided on the right of the needle thread take-up 32 in the head 18. The threading mechanism 38 includes a moving mechanism 52 for moving a thread holding member 50 serving as a threading member and a thread hooking mechanism 55 provided on the left of the cassette attaching portion 46. The thread holding member 50 and the moving mechanism 52 will first be described. The moving mechanism 52 moves the thread holding member 50 between a first position where the thread holding member is close to the needle eye 51 of the needle 36 and a second position where the thread holding member 50 is away from the needle eye 51, as shown in FIGS. 1 to 5. The moving mechanism 52 is fixed via a support block 54 and a mounting member 56 to a machine frame 24. The mounting member 56 is provided with a guide member 160 covering a distal end of the needle thread take-up 32.

Figure 6A:
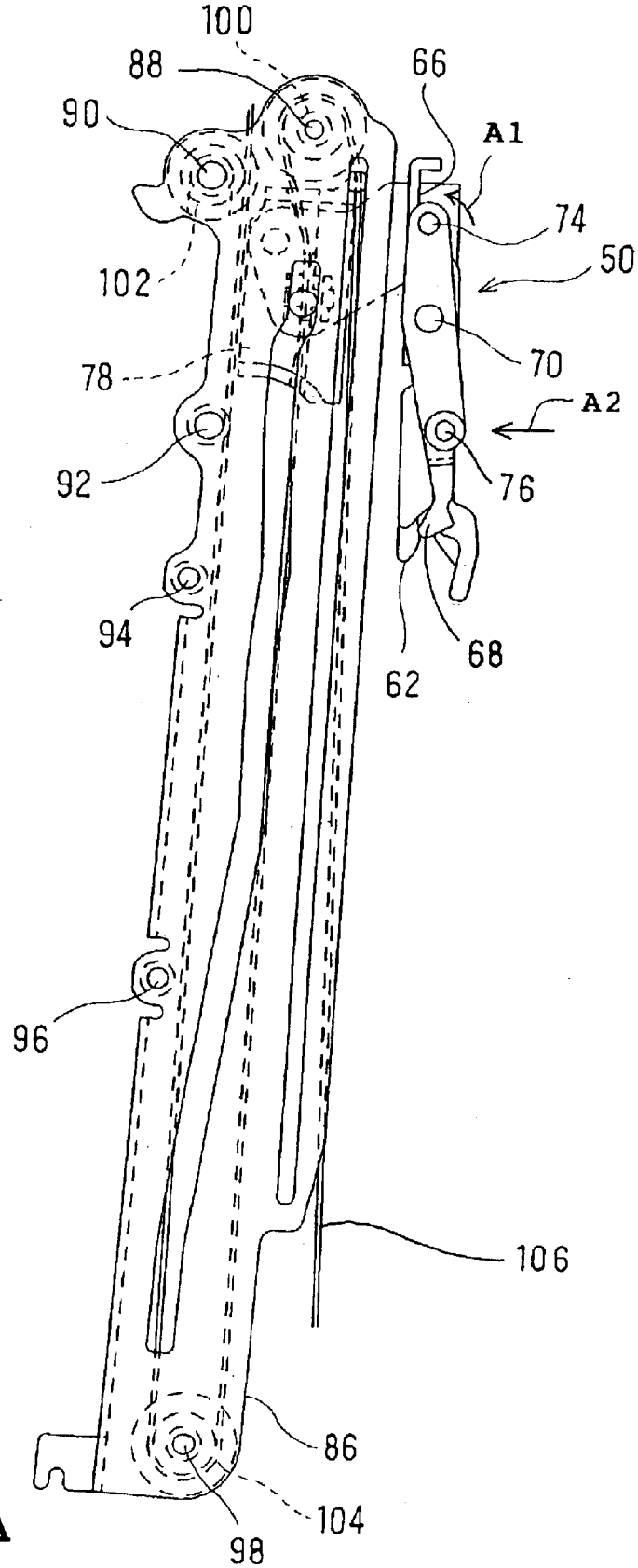
FIGS. 6A, 6B and 6C are left side, front and right side views of components constituting a part of the moving mechanism respectively.
Figure 6B:
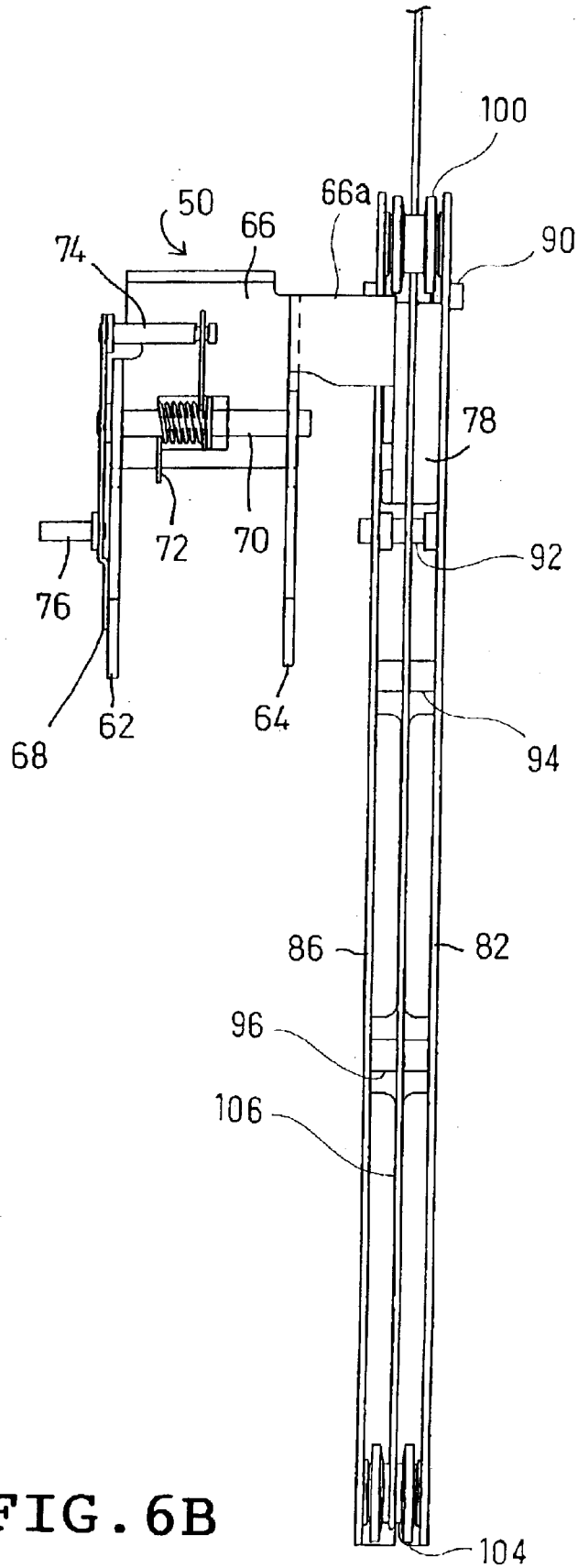
Figure 6C:
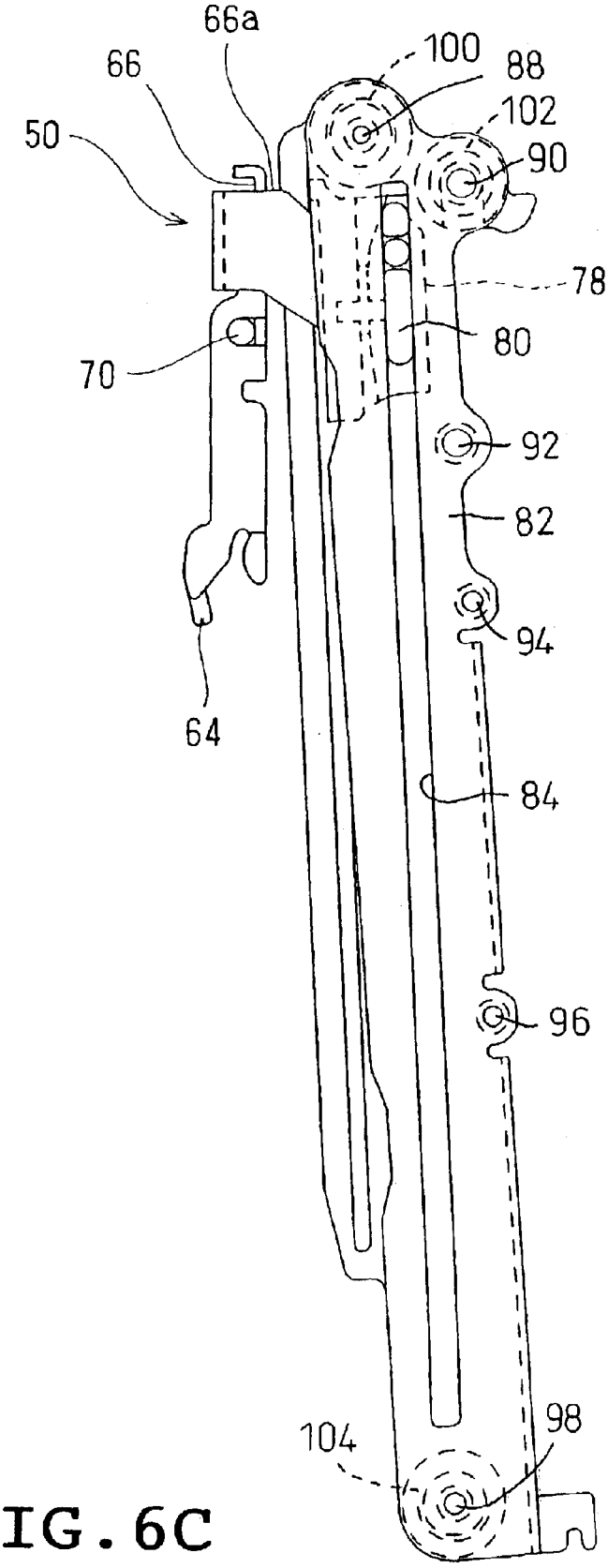

The thread holding member 50 has two parallel thread holding arms 62 and 64 connected together by a connecting portion 66, as shown in FIGS. 6A to 6C. A swinging member 68 has a middle portion supported, via a swinging shaft 70, on a left side of the thread holding arm 62 located on the left as viewed in FIG. 6B, so as to be swung. A pin 74 is fixed to an upper end of the swinging member 68. A coil spring 72 is provided around the swinging shaft 70 and has one of two ends abutted against the pin 74. As the result of the foregoing construction, the swinging member 68 is urged to pivot about the shaft 70 in a direction of arrow A1 in FIG. 6A. In this case, a lower end of the swinging member 68 is located near a distal end of the thread holding arm 62. An abutting pin 76 projecting leftward as viewed in FIG. 6B is fixed to the swinging member 68 so as to be located lower than the swinging shaft 70. When the abutting pin 76 is pressed in a direction of arrow A2 in FIG. 6A, the swinging shaft 68 pivots in a direction opposite the arrow A2 against spring force of the spring 72, so that the lower end of the swinging member is departed from the distal end of the arm 62.

The connecting portion 66 includes a connecting strip 66*a* formed integrally on the right portion thereof as viewed in FIG. 6B. An interlocking member 78 is fixed to the connecting strip 66*a* which is movably disposed between a pair of movable support plates 82 and 86 serving as moving supporting members. The interlocking member 78 functions as a supporting member for supporting the threading member (thread holding member 50). The movable support plates 82 and 86 are connected to each other by six spacing pins 88, 90, 92, 94, 96 and 98 so as to be spaced from each other. The movable support plate 82 has a guide groove 84 extending lengthwise. The interlocking member 78 has a protrusion 80 which is slid in the guide groove 84. The interlocking member 78 and the movable support plates 82 and 86 are disposed between a pair of stationary support plates 108 and 122 serving as stationary supporting members, as shown in FIGS. 6A to 6C, 7 and 8. The stationary support plates 108 and 122 are connected to each other by spacing pins 124, 126, 128 and 130 so as to be spaced from each other. Two fixed support pins 110 and 116 are fixed to an upper left portion of the stationary support plate 108, and a fixed support pin 112 is fixed to a lower right portion of the stationary support plate 108, as viewed in FIG. 7. The fixed support pins 110 and 112 serve as upper and lower fixed portions respectively in the present invention.

Figure 7:
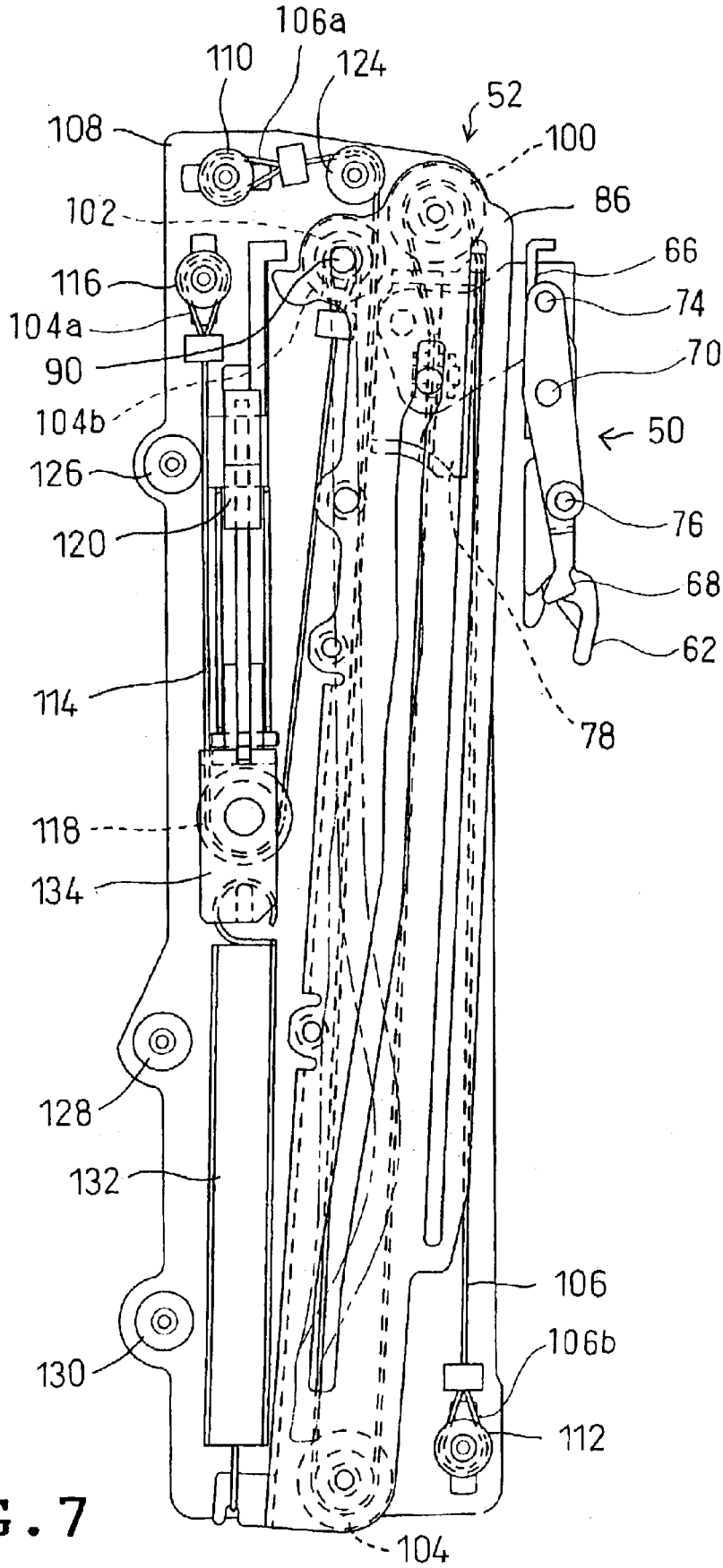
FIG. 7 is a left side view of the overall construction of the moving mechanism.
Figure 8:
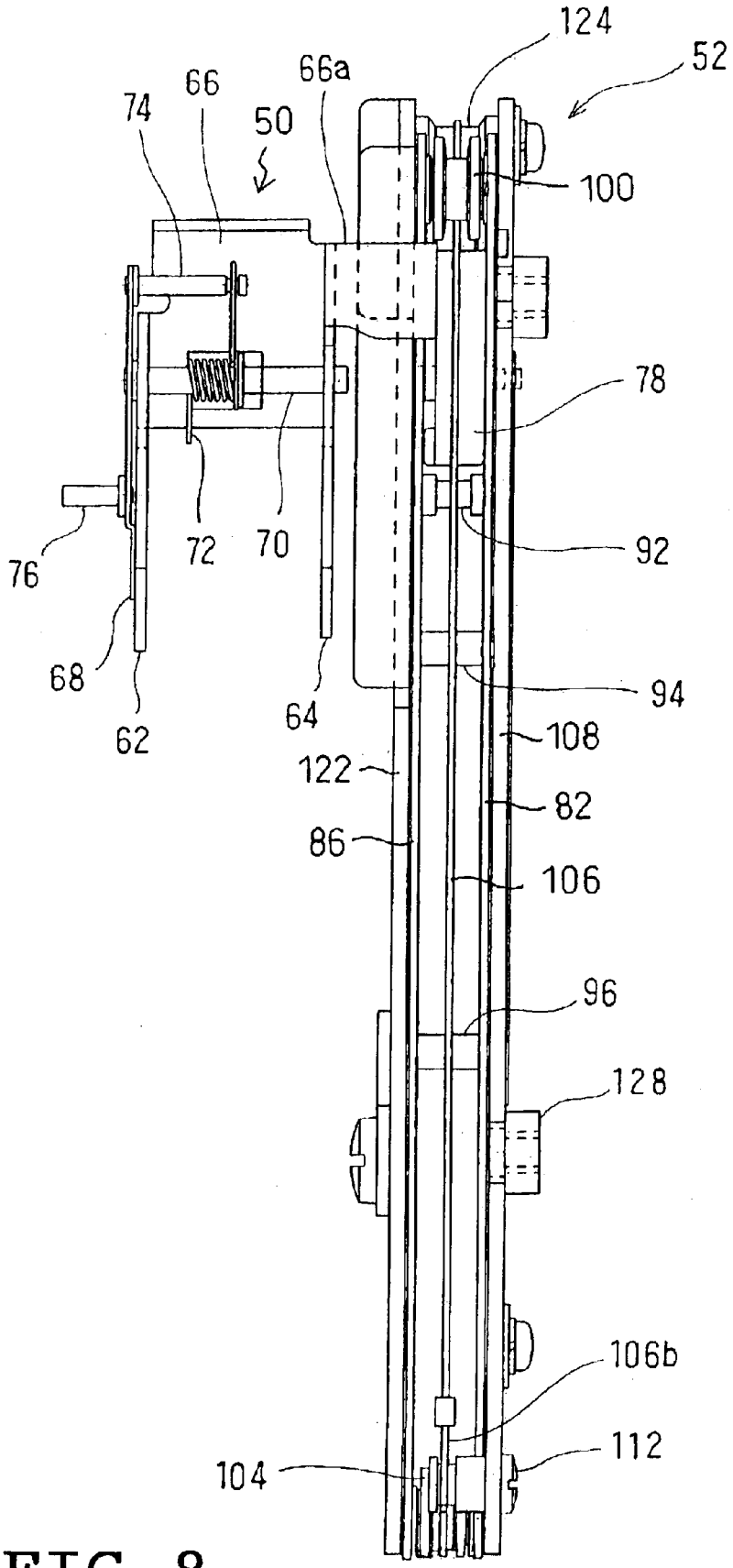
FIG. 8 is a front view of the overall construction of the moving mechanism.
Figure 9A:
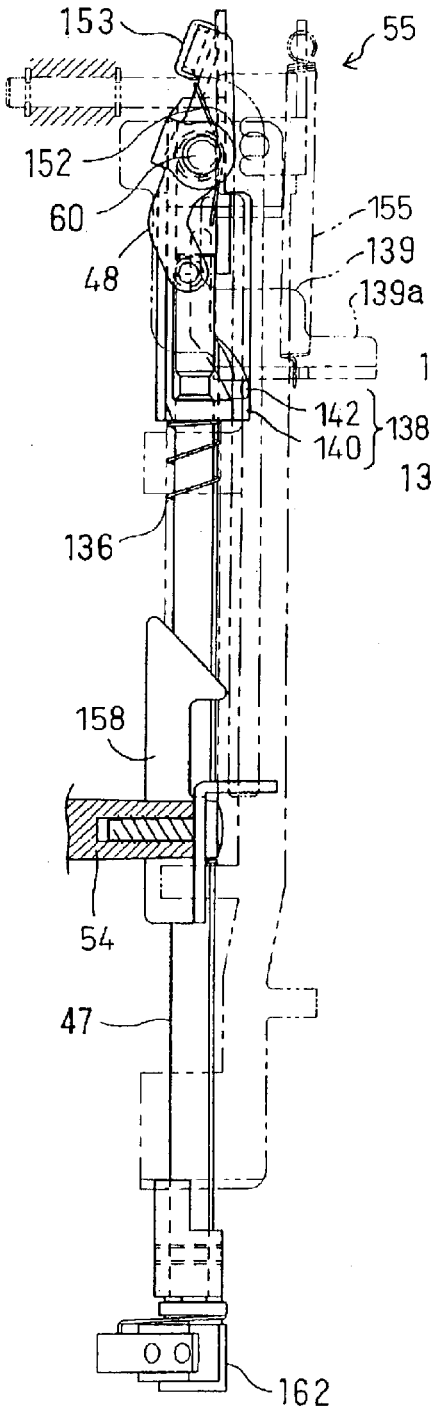
FIGS. 9A and 9B are front and left side views of a threading hook mechanism respectively.
Figure 9B:
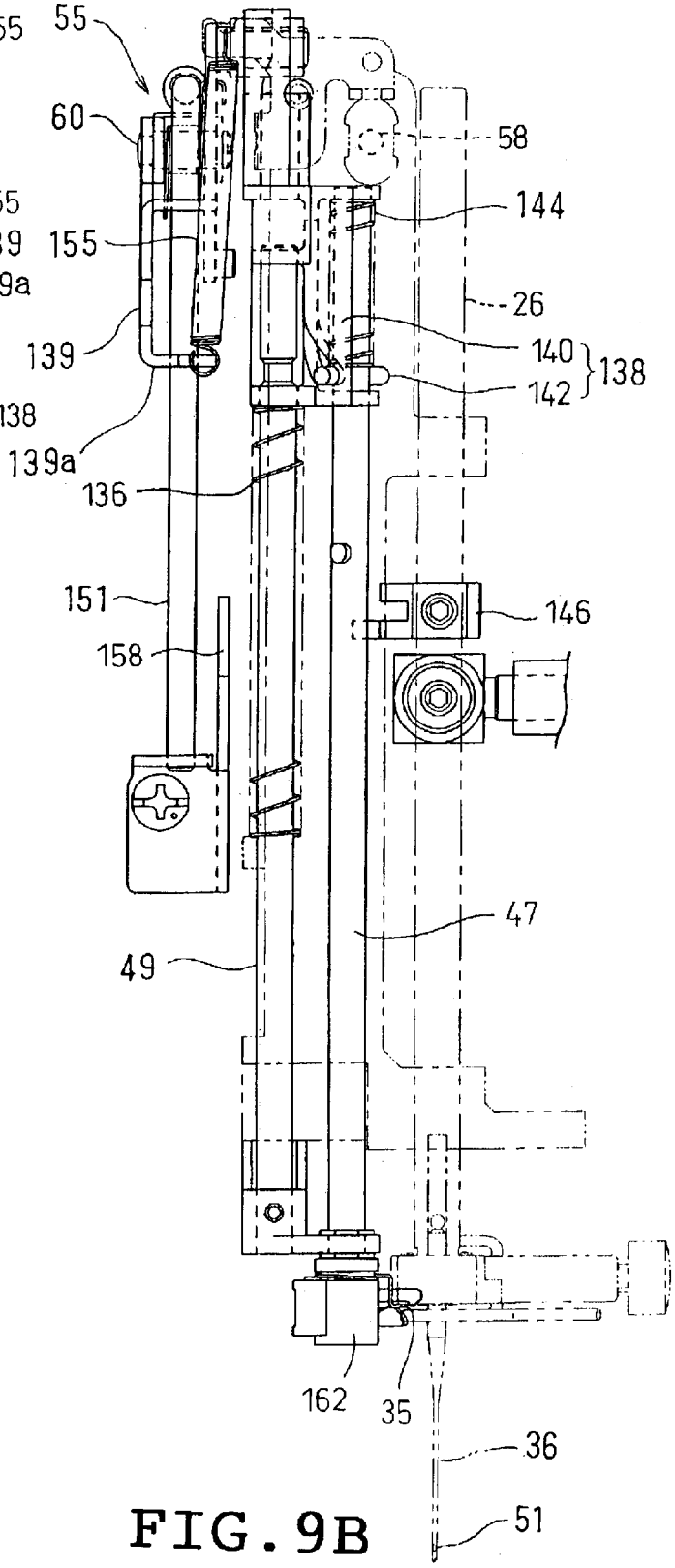

A cassette contact 120 serving as an operating member is disposed between the stationary support plates 108 and 122. A running block 118 serving as a transmitting actuating member is also disposed between the stationary support plates 108 and 122. The running block 118 is rotatably supported on a block supporting member 134, which is joined to a lower portion of the cassette contact 120 so as to be moved with the cassette contact. A drawing spring 132 is provided between a lower portion of the block supporting member 134 and lower portions of the movable support plates 82 and 86. The drawing spring 132 returns the overall moving mechanism 52 to an original state as shown in FIG. 7 and thus serves as a returning member. The cassette contact 120 is disposed to be slid in a guide groove (not shown) formed in the stationary support plate 122 so as to extend vertically as viewed in FIG. 7. The cassette attaching portion 46 includes a portion corresponding to the guide groove. A slit (not shown) is formed in the portion of the cassette attaching portion 46. The cassette contact 120 includes a part protruding through the guide groove and the slit into the cassette attaching portion 46. See FIG. 1. The cassette contact 120 is pressed downward by the thread cassette 44 when the cassette is attached to the cassette attaching portion 46. When the thread cassette 44 is pressed downward a predetermined distance, the cassette contact 120 is moved out of the movement path of the thread cassette.

Three pulleys 100, 102 and 104 are rotatably mounted on the spacing pins 88, 90 and 98 respectively. A metal slender string-shaped member, for example, a wire 106 is stretched between the pulleys 100 and 104 and the spacing pin 124. The pulley 102 is in contact with a part of the wire 106 located between the spacing pin 124 and the pulley 104, whereupon the wire 106 is prevented from being located on the left of the pulley 104 as viewed in FIG. 7. The wire 106 has both ends including annular ends 106*a* and 106*b* formed by folding back parts thereof, respectively. The annular ends 106*a* and 106*b* of the wire 106 are caused to pass around the fixed support pins 110 and 112 respectively. The interlocking member 78 is fixed to a part of the wire 106 nearer to the pulley 100 between the pulleys 100 and 104. As the result of the above-described construction, the movement support plates 82 and 86 movably supported via the wire 106 on the stationary support plate 108.

On the other hand, another wire 114 having a smaller diameter than the wire 106 extends between the spacing pin 90 and the fixed support pin 116. Two annular ends 114*a* and 114*b* at both ends of the wire 114 are caused to pass around the spacing pin 90 and fixed support pin 116 respectively. A middle portion of the wire 114 is hooked on the running block 118. The spacing pin 90 is moved relative to the stationary support plate 108. Accordingly, the annular end 114*a* of the wire 114 is a free end, whereas the annular end 114*b* is a fixed end. In the embodiment, the wire 106 serves both as a moving string-shaped member and as a first string-shaped member. The movable support plates 82 and 86 and pulleys 100 and 104 serve as a moving actuating member. Particularly in the embodiment, a part of the wire 10 extending from the interlocking member 78 via the pulley 104 to the fixed support pin 110 constitutes a descent string-shaped member, whereas another part of the wire 10 extending from the interlocking member 78 via the pulley 100 to the fixed support pin 112 constitutes an ascent string-shaped member. Furthermore, the wire 114 serves both as a transmitting string-shaped member and as a second string-shaped member. The spacing pin 90 serves as a mounting portion. The wire 114 and running block 118 constitute a transmitting mechanism.

When the cassette contact 120 is pressed downward distance d by the thread cassette 44, the running block 118 is moved downward distance d together with the cassette contact 120. A portion of the running block 118 abutting the wire 114 is moved distance d toward the annular end 114*a* side and downward distance d. Accordingly, the annular end 114*a* of the wire 114 is drawn downward twice as long as the distance d (2×d). Consequently, the spacing pin 90 and accordingly, the movable support plates 82 and 86 are moved downward distance (2×d). The pulleys 100 and 104 mounted on the respective movable support plates 82 and 86 are also moved downward distance (2×d) when the movable support plates 82 and 86 are moved downward. The portions of the pulleys 100 and 104 abutting the wire 106 are then moved toward the annular end 106*b* side distance (2×d) and downward distance (2×d). Consequently, a portion of the wire 106 located between the pulleys 100 and 104 is moved downward twice as long as distance (2×d) and accordingly, four times as long as distance d (4×d).

Figure 14:
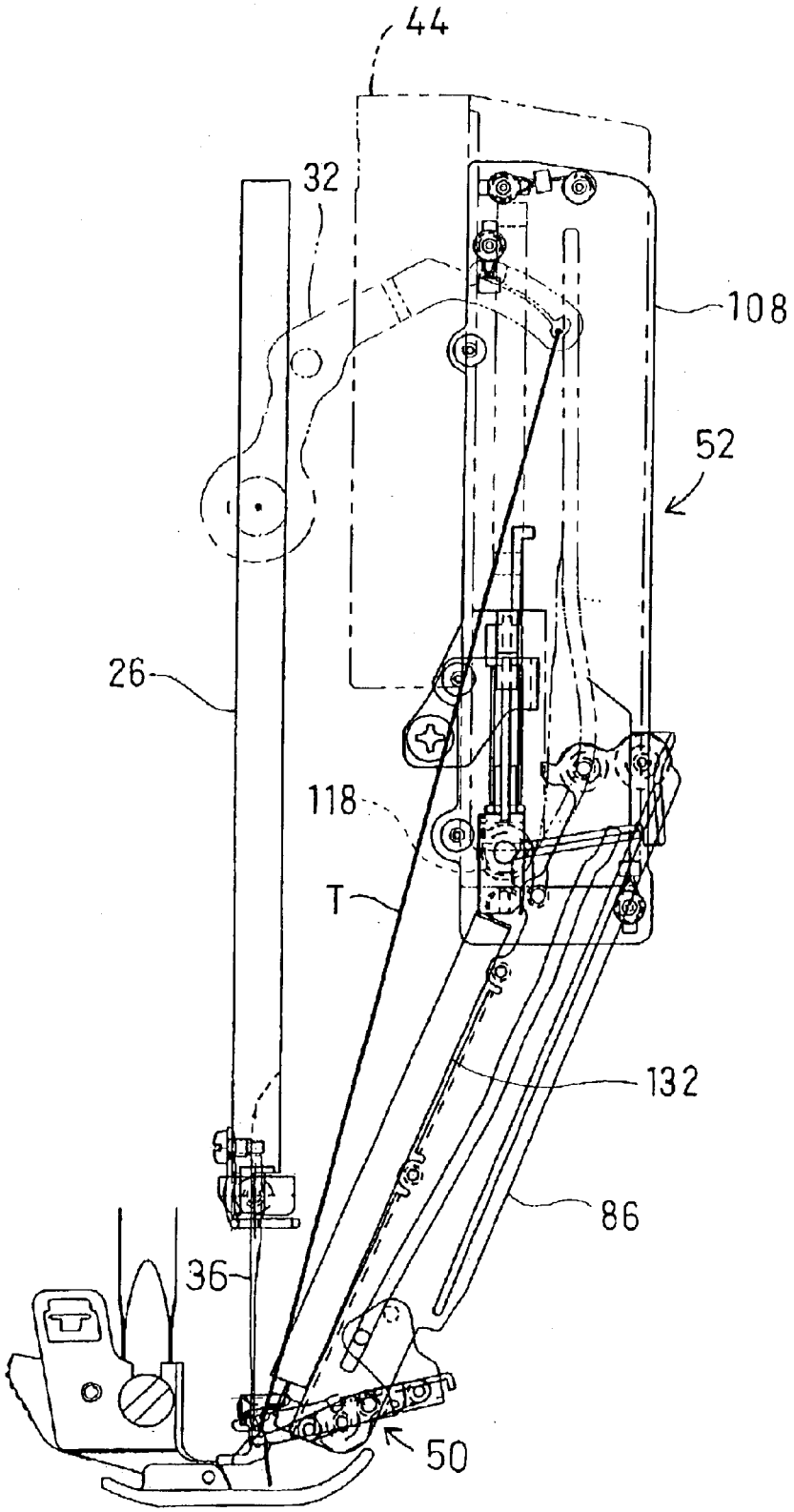
FIG. 14 illustrates the moving mechanism in the case where the thread holding member assumes a lowermost position.

In the embodiment, the moving mechanism 52 is constituted by the interlocking member 78, movable support plates 82 and 86, stationary support plates 108 and 122, pulleys 100, 102 and 104, running block 118, fixed support pins 110, 112 and 116, spacing pins 90 and 124, and wires 106 and 114. The moving mechanism 52 in the embodiment quadruples a movement amount of the cassette contact 120, transmitting the quadrupled movement amount to the thread holding member 50. The movable support plates 82 and 86 assume the respective positions as shown in FIG. 7 or non-operative conditions when the cassette contact 120 is non-operative, whereas the movable support plates 82 and 86 are moved to the respective positions as shown in FIG. 14 or operative positions.

The threading hook mechanism 55 will be described with reference to FIGS. 4, 9 to 12. The threading hook mechanism 55 is constructed to swing about a swinging central shaft 58 (see FIG. 4) together with the needle bar 26. The mechanism 55 includes a threading hook 35, a moving mechanism 138 for moving the hook 35 so that the hook is advanced and retreated through the needle eye 51 of the needle 36, a threading bar 47 provided in parallel with the needle bar 26 and moved up and down, a guide bar 49 for supporting the threading bar 47 so that the threading bar is moved up and down, a hook supporting member 162 provided on a lower end of the threading bar 47 for holding the threading hook 35, a compression coil spring 136 provided around the guide bar 49 for urging the bar upward, a cassette contact 139 for lowering the threading bar 47 against an urging force of the coil spring 136, thereby passing the hook 35 through the needle eye 55, a transmitting member 48 for transmitting operation of the cassette contact 139 to the threading bar 47, and an abutting member 158 shutting down transmission by the transmitting member 48. The threading hook 35 has a recess (not shown) formed in a lower portion thereof. The needle thread T is caught by the recess.

Figure 10:
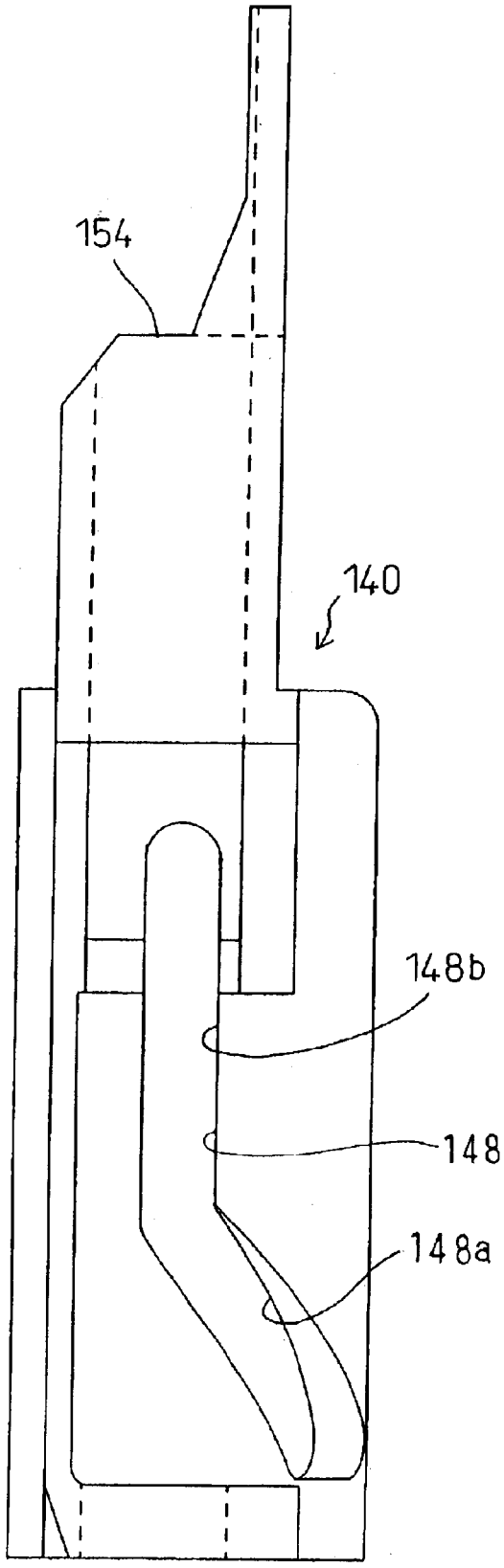
FIG. 10 is a view of a groove of a rotation imparting member and construction of an abutting member.

The moving mechanism 138 includes a rotation imparting member 140 provided on upper portions of the threading bar 47 and guide bar 49, a pin 142 provided on the threading bar 47 so as to extend horizontally through the threading bar 47, and a height adjusting member 146 fixed to the needle bar 26. The coil spring 136 is disposed between an engaging portion 49*a* provided on the guide bar 49 and the rotation imparting member 140. A compression coil spring 144 is provided around a portion of the threading bar 47 located between an upper portion of the rotation imparting member 140 and the pin 142. The rotation imparting member 140 has a groove 148 formed in a portion thereof corresponding to the threading bar 47 as shown in FIG. 10. The groove 148 includes a lower half spiral groove 148*a* and an upper half straight groove 148*b*. The pin 142 has one end inserted into the groove 148. An abutting portion 154 is provided on an upper portion of the rotation imparting member 140. The cassette contact 139 is supported on a guide shaft 151 fixed in the head 18 so as to be moved upward and downward as shown in FIGS. 9, 11A, 11B, 12A and 12B. The cassette contact 139 is urged upward by the drawing spring 155 and includes an abutting portion 139*a* protruding forward from a slit 45 provided in the cassette attaching portion 46. See FIG. 1. The abutting portion 139*a* is pressed downward by the thread cassette 44 when the thread cassette 44 is attached to the cassette attaching portion 46. The overall cassette contact 139 is moved downward along the guide shaft 151 against the urging force of the drawing spring 155.

Figure 11A:
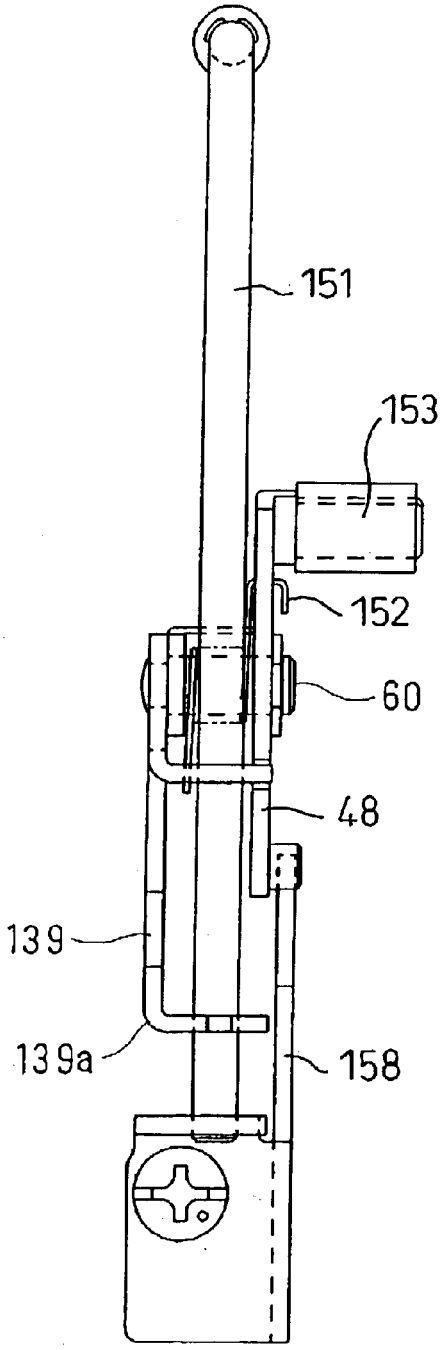
FIGS. 11A and 11B are front and right side views of a transmitting member assuming a transmission position and the abutting member.
Figure 11B:
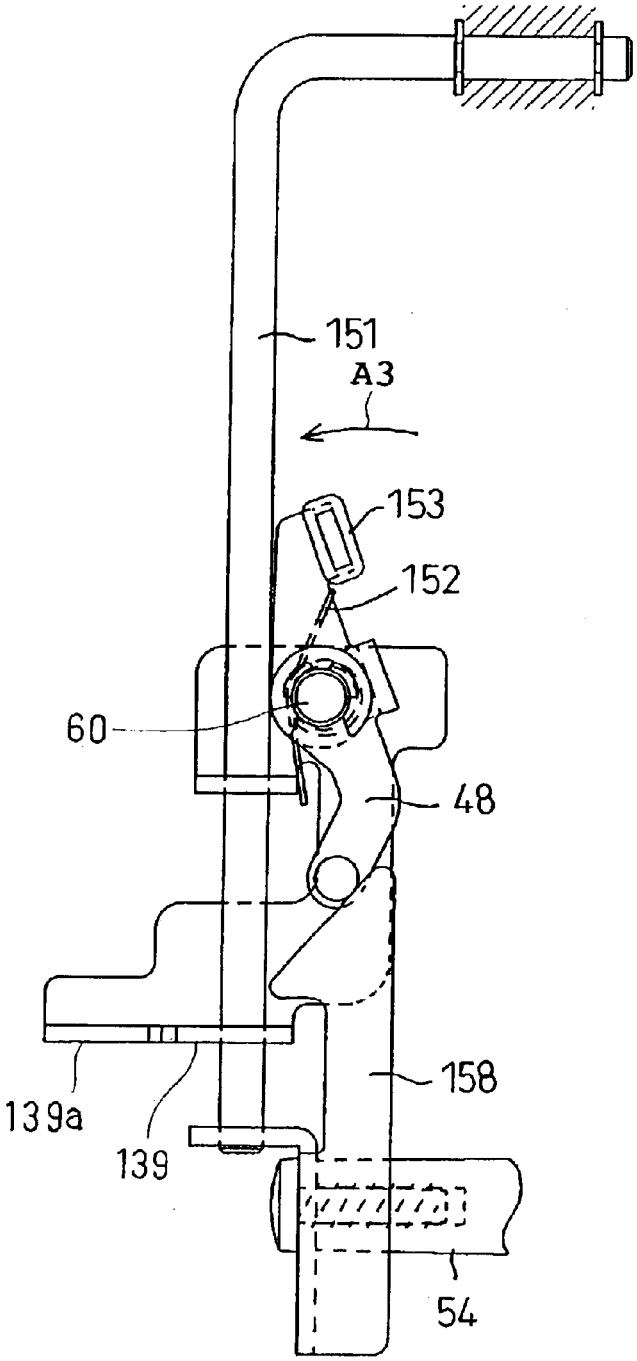
Figure 12A:
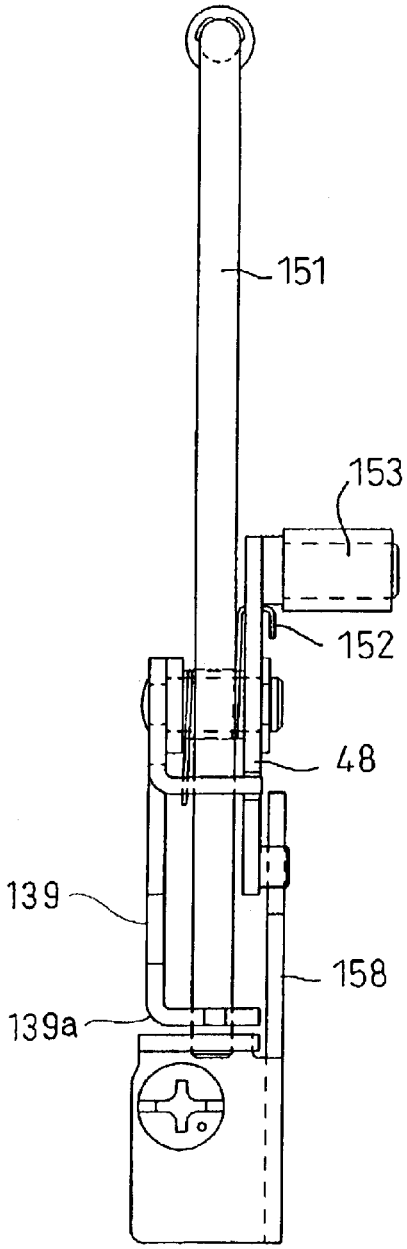
FIGS. 12A and 12B are front and right side views of the transmitting member assuming a shutdown position and the abutting member respectively.
Figure 12B:
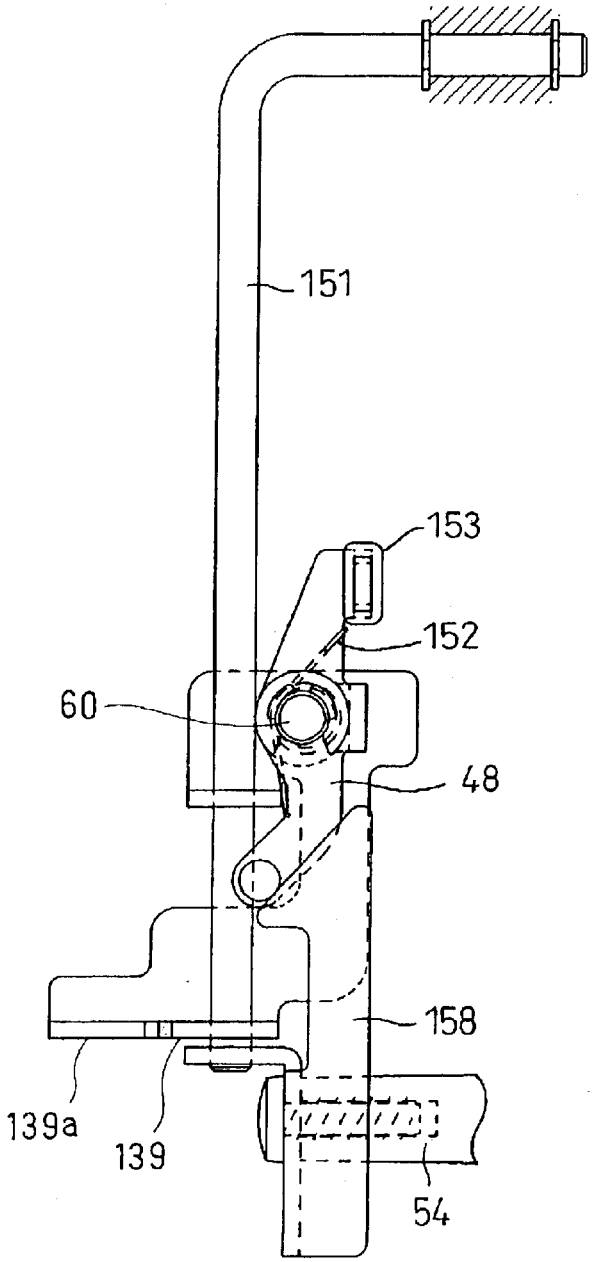
Figure 13:
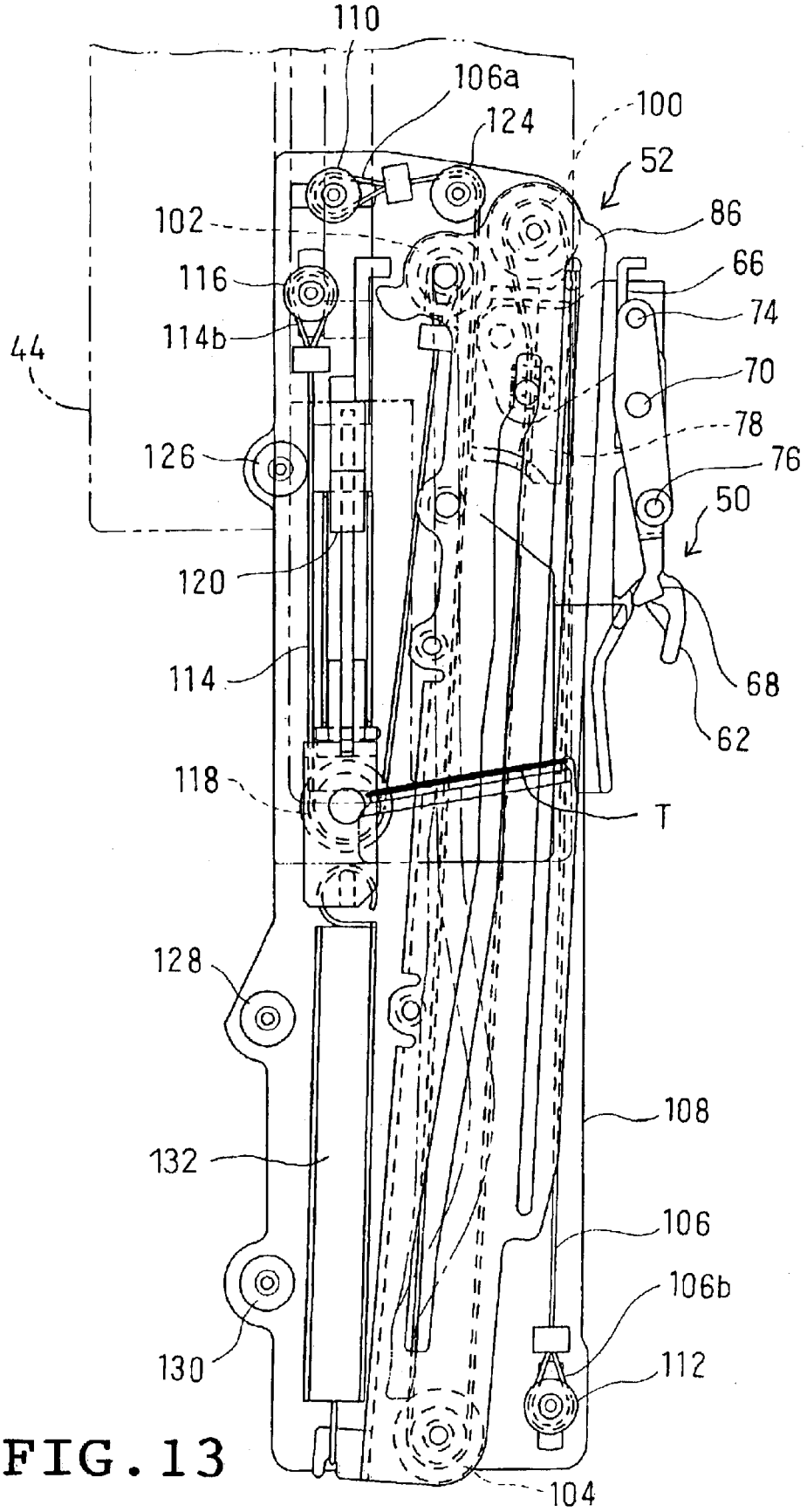
FIG. 13 is a left side view of a thread cassette inserted into a cassette installing section and the moving mechanism.

The transmitting member 48 is pivotally supported on a horizontal shaft 60 further mounted on an upper portion of the cassette contact 139. The transmitting member 48 is urged in a direction shown by arrow A3 in FIG. 11B by a torsion coil spring 152 provided around the horizontal shaft 60. The transmitting member 48 is moved between a transmission position as shown in FIGS. 11A and 11B and a non-transmission position as shown in FIGS. 12A and 12B. An upper end 153 of the transmitting member 48 abuts an abutting portion 154 of the rotation imparting member 140 from above when the transmitting member is in the transmission position. As a result, downward movement of the cassette contact 139 is transmitted via the rotation imparting member 140 to the threading bar 47. In other words, the transmitting member 48 transmits force by which the cassette contact 139 moves the threading hook 35 downward. On the other hand, the upper end 153 of the transmitting member 48 is separated from the abutting portion 154 of the rotation imparting member 140 when the transmitting member is in the non-transmission position. As a result, the operation of the cassette contact 139 is prevented from being transmitted to the rotation imparting member 140 and the threading bar 47, whereupon the threading bar 47 is allowed to be ascended by the urging force of the coil spring 136.

The transmitting member 48 is made of a metal, whereas the rotation imparting member 140 is made of a resin. For the purpose of protecting the abutting portion 154 of the rotation imparting member 140, a protecting member is wound on the upper end 153 of the transmitting member 48. The protecting member is made of a synthetic resin such as ABS (acrylonitrile butadiene stylene) or polyacetal.

The abutting member 158 is fixed to the support block 54, which is further fixed to the machine frame 24. Accordingly, the abutting member 158 assumes a predetermined position irrespective of up-and-down and horizontal swinging of the needle bar 26 and the needle 36. When the cassette contact 139 is moved downward such that the transmitting member 48 reaches a predetermined position, the abutting member 158 abuts the transmitting member 48. As a result, the transmitting member 48 is caused to pivot in a direction opposite arrow A3 in FIG. 11B against the urging force of the torsion coil spring 152 thereby to be moved to the non-transmission position. The thread holding member 50 is moved slightly upward from the lowermost position so that the needle thread T held by the thread holding member 50 is pressed against the threading hook 35 having been passed through the needle eye 51 from below, as will be described later. The abutting member 158 then abuts the transmitting member 48 when the transmitting member has reached the predetermined position.

The threading operation is carried out by attaching the thread cassette 44 to the cassette attaching portion 46. Operations of various components in this case will be described with reference to FIGS. 13 to 18. Firstly, the user sets the needle bar 26 at a predetermined height-position for execution of the threading operation. The bobbin 42 is then set in the thread cassette 44 and the needle thread T is drawn from the bobbin 42 to be caught on a predetermined portion of the thread cassette 44. The thread cassette 44 is then inserted into the cassette attaching portion 46 from above and pressed downward until the lower portion of the thread cassette 44 reaches the bottom of the cassette attaching portion 46. In the above-described process of attaching the thread cassette 44 to the cassette attaching portion 46, the needle thread T caught on the thread cassette 44 is lowered along an upper inclined face of the guide member 160 (see FIG. 3) to be caught by the needle thread take-up 32. Furthermore, a part of the needle thread T other than the part caught by the needle thread take-up 32 is caught by the thread holding arms 62 and 64 of the thread holding member 50. When the needle thread T is caught by the thread holding arms 62 and 64, the abutting pin 76 is pressed in the direction of arrow A2 in FIG. 6A by a rib (not shown) provided on the thread cassette 44 such that the lower end of the swinging portion is separated from the distal end of thread holding arm 62. See FIG. 6A.

Figure 15:
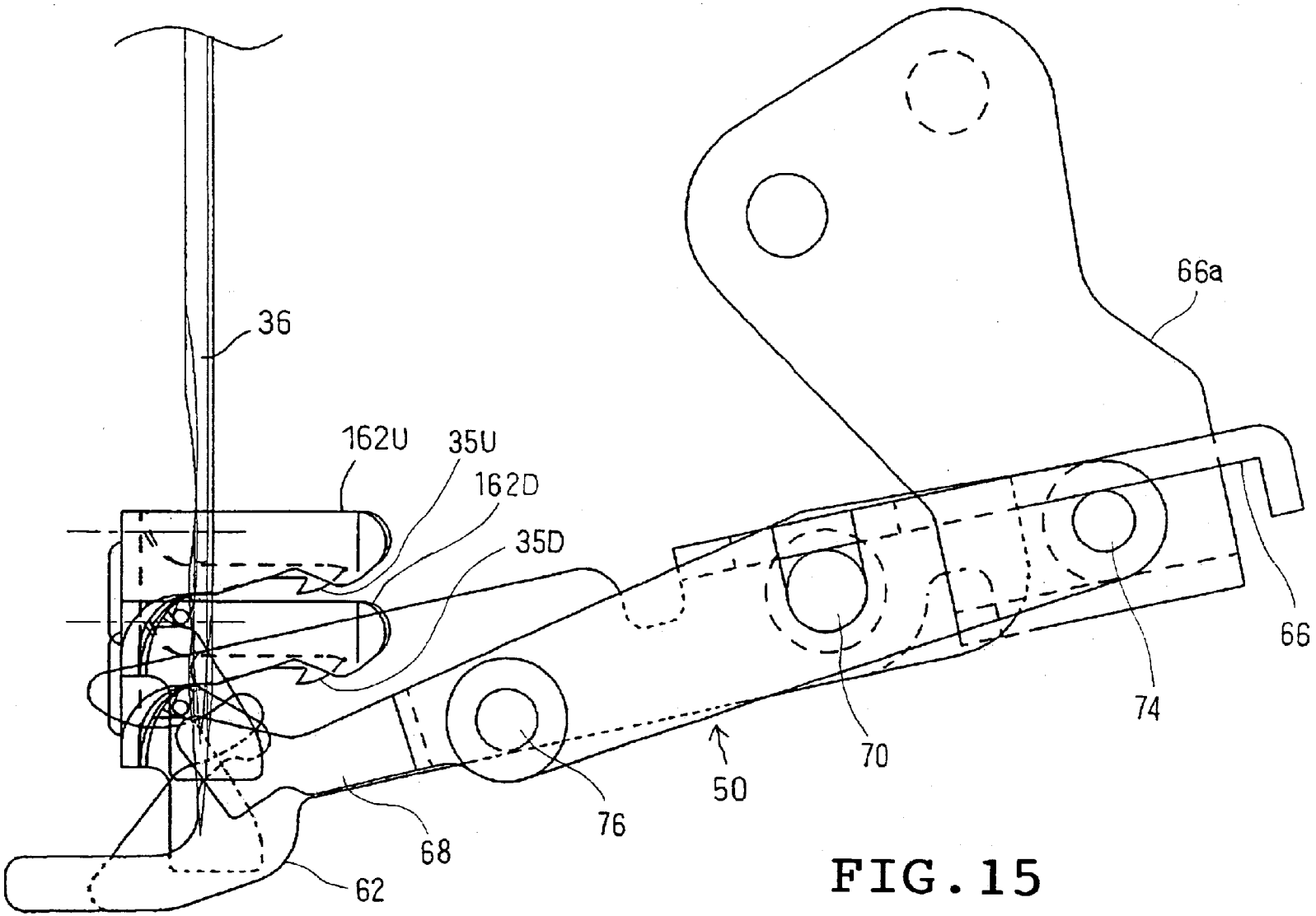
FIG. 15 illustrates a positional relation between the threading hook passed through a needle eye and the thread holding member assuming the lowermost position.
Figure 16:
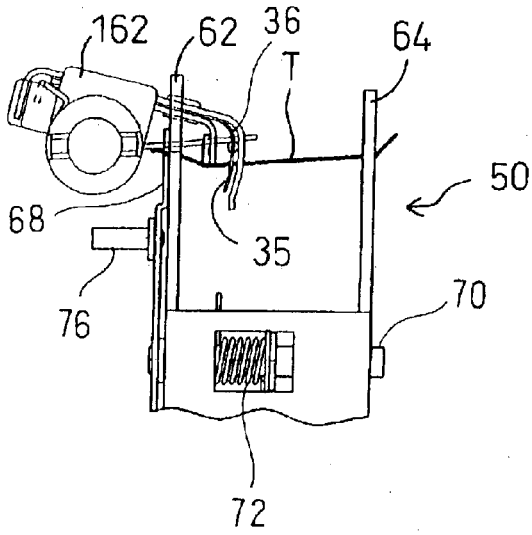
FIG. 16 illustrates a relation between the threading hook passed through the needle eye and a needle thread held by the thread holding member.

In the thread cassette attaching process, furthermore, the cassette contact 120 is pressed downward by a right-hand part of the thread cassette 44 and the cassette contact 139 is pressed downward by a central part of the thread cassette 44. When the cassette contact 120 is pressed downward by the thread cassette 44, the moving mechanism 52 is operated so that the moving support plates 82 and 86 and interlocking member 78, and that is, the thread holding member 50 are moved downward, as described above. In this case, a movement distance of the thread holding member 50 becomes about four times as long as a movement distance of the cassette contact 120, as described above. When the thread holding member 50 has been moved to the lowermost position as shown in FIG. 14, the thread holding arms 62 and 64 are located lower than the needle eye 51. See FIG. 15. FIG. 15 shows the threading hook 35U advanced through the needle eye 51 when the needle 36 is located at the uppermost position in a threading range and the thread holding member 162U and the threading hook 35D advanced through the needle eye 51 when the needle 36 is located at the lowermost position in the threading range and the thread holding member 162D. Thus, in the embodiment, the location where the thread holding arms 62 and 64 hold the needle thread T when the thread holding member 50 is at the lowermost position is lower than the threading hook 35 projecting from the needle eye 51 even when the needle 36 assumes the lowermost position in the threading range. Consequently, the thread holding member 50 can be moved along a predetermined route irrespective of the stop position of the needle 36 and accordingly, the construction of the moving mechanism 52 can be simplified.

On the other hand, when the cassette contact 139 is pressed downward by the thread cassette 44, the rotation imparting member 140 is moved downward against the urging force of the coil spring 136 and with this, the threading bar 47 is moved downward. The downward movement of the threading bar 47 is prevented when the other end of the pin 142 abuts the height adjusting member 146. At this time, the distal end of the threading hook 35 is at the same level as the needle eye 51. When the cassette contact 139 is further pressed downward, the rotation imparting member 140 is further moved downward against the urging force of the coil spring 144. In this case, since the pin 142 is guided along the helical groove 148*a* to the straight groove 148*b* of the groove 148, the threading bar 47 is rotated with descent of the rotation imparting member 140. As a result, the threading hook 35 is advanced through the needle eye 51. The threading hook 35 is advanced through the needle eye 51 after the thread holding arms 62 and 64 have been moved lower than the needle eye. See FIG. 16.

The cassette contact 120 is moved out of the movement path of the thread cassette 44 when the threading hook 35 has been advanced through the needle eye 51. Consequently, the moving mechanism 52 is returned to the former state as shown in FIG. 7 by the drawing spring 132. In this case, the thread holding member 50 is moved upward so that the needle thread T extended between the thread holding arms 62 and 64 intersects the distal end of the threading hook 35 projecting through the needle eye 51. In other words, the needle thread T is positively pressed against the threading hook 35. The abutting member 158 abuts the transmitting member 48 thereby to move the latter from the transmission position to the non-transmission position when the thread holding member 50 is moved to a close position where the thread holding arms 62 and 64 are located slightly higher than the threading hook 35. In this case, the pin 142 of the threading bar 47 ascends to a middle of the straight groove 148*b*. Furthermore, as the result of movement of the transmitting member 48 to the non-transmission position, the abutting portion 154 is disengaged from the upper end 153 of the rotation imparting member 140. Consequently, the urging force of the coil spring 144 moves the rotation imparting member 140 upward and the threading bar 47 is rotated in the reverse direction, so that the threading hook 35 is returned through the needle eye 51. Continuously, the urging force of the coil spring 136 moves the threading bar 47 and the rotation imparting member 140 upward, whereupon the threading hook 35 is returned to the former position.

Figure 17:
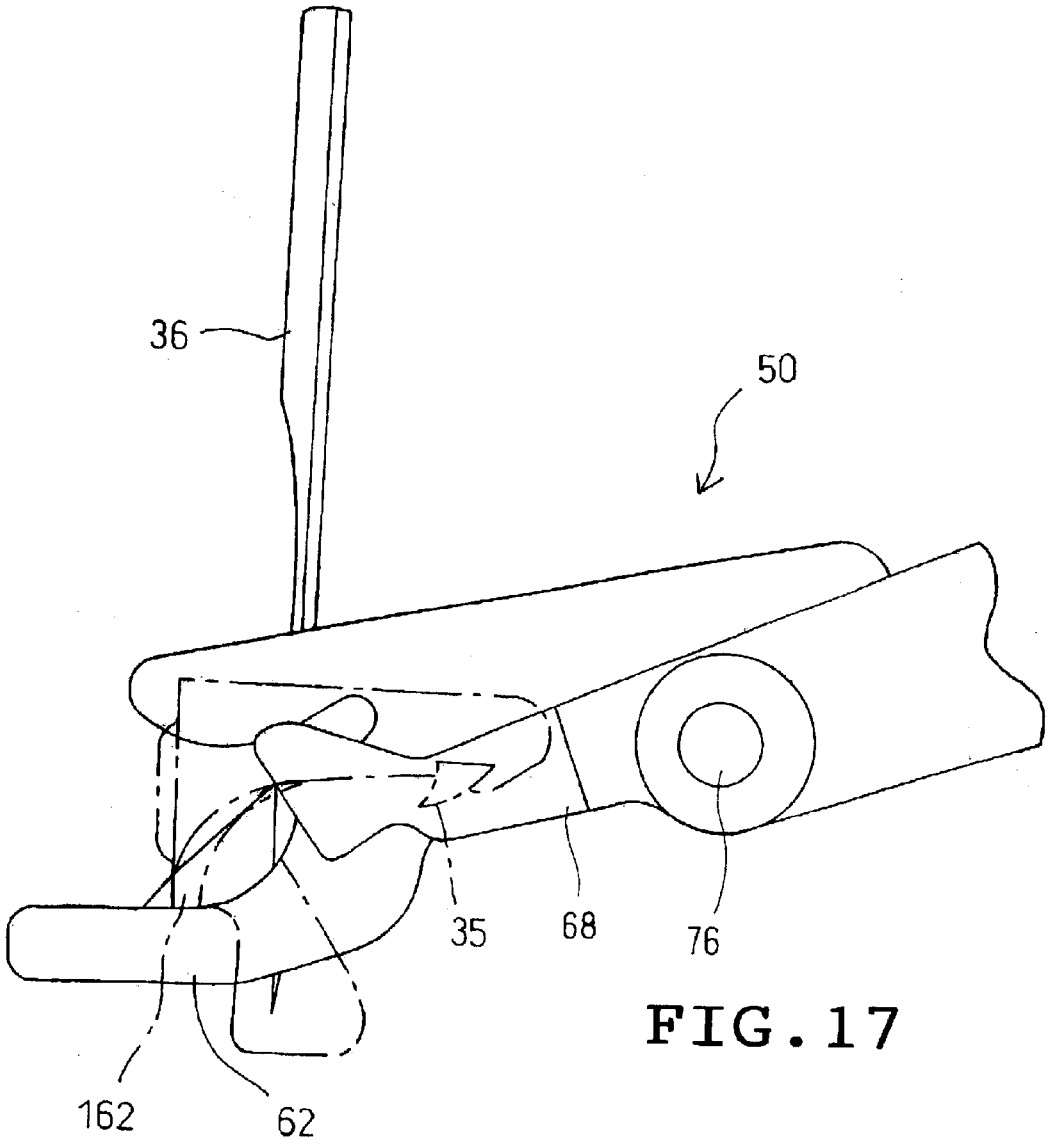
FIG. 17 illustrates a condition where a hook holding member and a thread holding member are in abutment.
Figure 18:
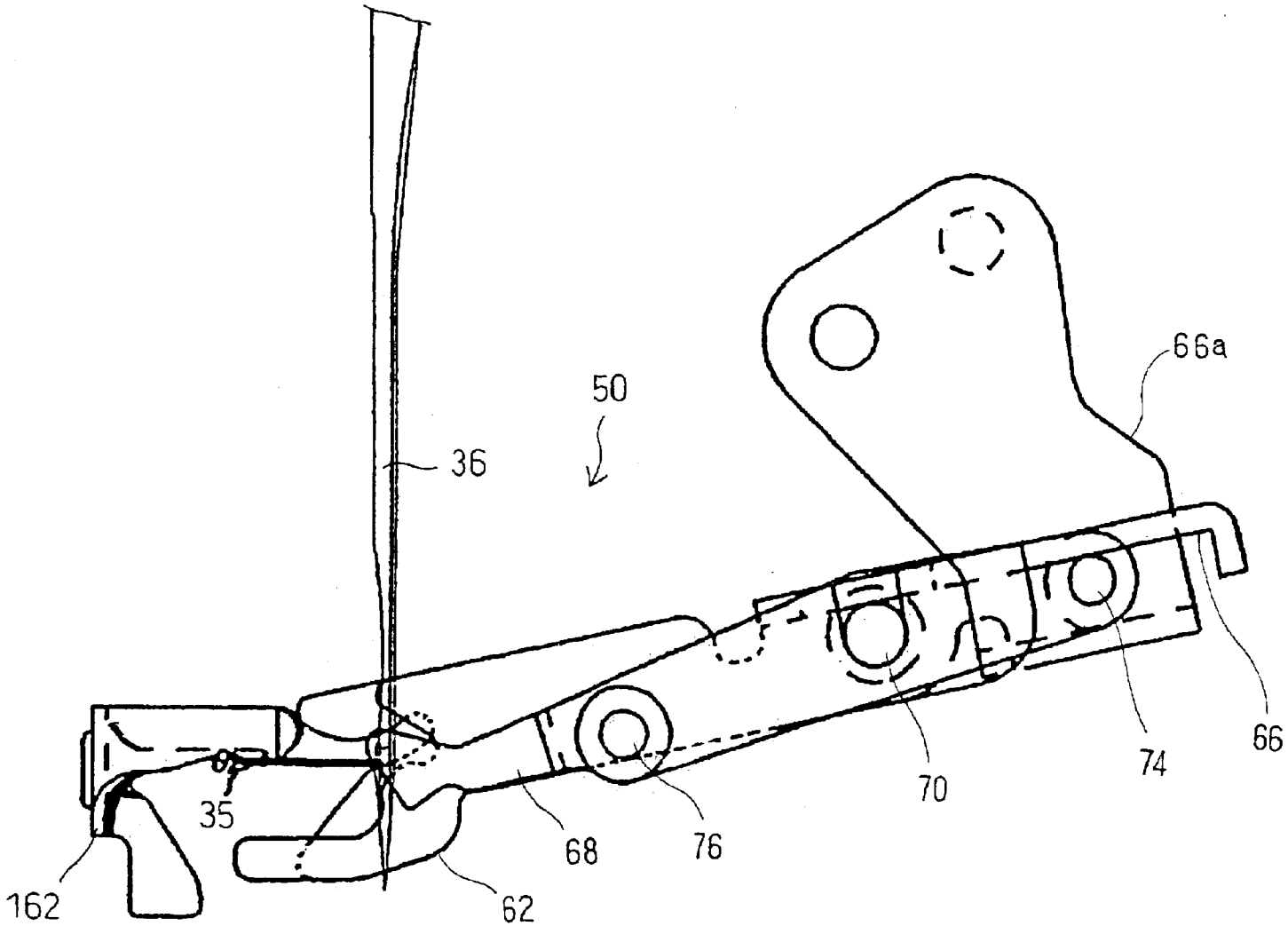
FIG. 18 illustrates a condition where the hook holding member and thread holding member have been disengaged from each other.

Furthermore, during the upward movement of the thread holding member 50, the distal end of the left thread holding arm 62 abuts a lower portion of the hook holding member 162, as shown in FIG. 17. Accordingly, an ascending speed of the thread holding member 50 is restrained. More specifically, load of abutting the thread holding member 50 against the hook holding member 162 is applied to the drawing spring 132 provided for returning the moving mechanism 52, so that the ascending speed of the thread holding member 50 is restrained. The abutment of the thread holding member 50 against the hook holding member 162 is continued until the threading hook 35 completely gets through the needle eye 51. When the threading hook 35 completely gets through the needle eye 51, the thread holding member 50 is released from the abutment against the hook holding member 162, whereupon the thread holding member 50 is moved upward with an increasing speed.

In the foregoing embodiment, the transmitting member 48 is moved to the non-transmission position by the abutting member 158 after the thread holding member 50 has been moved to the close position located higher than the threading hook 35 advanced through the needle eye 51. Consequently, the needle thread T held by the thread holding arms 62 and 64 can reliably be caught by the threading hook 35. Furthermore, the abutting member 158 is provided on the support block 54 fixed to the machine frame 24. In other words, the abutting member 158 is independent from the drive mechanisms 28 and 30. Consequently, the abutting member 158 can reliably cut off transmission by the transmitting member 48.

Several modified forms will now be described. The present invention may be applied to sewing machine provided with no thread cassette and sewing machines provided with a thread cassette and a threading mechanism operated irrespective of attachment of the thread cassette. In each case, manually operated operating levers are provided for pressing the cassette contacts 120 and 139 downward respectively. The present invention may further be applied to sewing machines in which the needle bar is not swung horizontally relative to the machine frame.

The thread holding member may hold the thread in a vertically extended state. In this case, the moving mechanism is constructed so that the thread is moved horizontally so as to intersect the threading hook. Furthermore, although the two thread holding arms 62 and 64 are moved in the foregoing embodiment, at least one thread holding arm may be moved only if the needle thread T is caused to intersect the threading hook 35. Additionally, the moving mechanism using the running block may move the threading hook 35.

The string-shaped member should not be limited to the slender wire and may be a belt with no teeth or a timing belt, instead. Furthermore, a mere circular cylindrical member may be used instead of the running block. Furthermore, the moving mechanism may comprise gears. The invention may be applied to sewing machine in which the needle 36 is swung in a back-and-forth direction as well as those in which the needle 36 is swung in the right-and-left direction. The moving mechanism may be constructed so that the thread holding member 50 is moved non-parallel with the needle 36, for example, obliquely relative to the needle. Additionally, the moving mechanism may be constructed so that the thread holding member is moved in parallel with the needle 36 when the thread holding member is descended or ascended.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A sewing machine comprising:

a sewing needle moved up and down and having an eye;

a threading hook passed through the eye of the needle;

an urging member for urging the threading hook upward;

an actuating member for moving the threading hook downward against an urging force of the urging member so that the threading hook is passed through the needle eye;

a transmitting member moved between a transmission position where an operation of the actuating member is transmitted to the threading hook and a non-transmission position where an operation of the actuating member is not transmitted to the threading hook:

a thread holding member for holding the thread;

a moving mechanism for moving the thread holding member near to a position where the thread held by the thread holding member is located near the threading hook having been passed through the eye of the needle; and an abutting member abutting the transmitting member when the thread holding member has been moved to the position where the thread held by the thread holding member is located near the threading hook having been passed through the eye of the needle, in order to move the transmitting member from the transmission position to the non-transmission position.

2. A sewing machine according to claim 1, further comprising a sewing machine frame, wherein the abutting member is disposed on the frame.

3. A sewing machine according to claim 1, wherein the transmitting member is caused to pivot thereby moving between the transmission position and the non-transmission position, and the abutting member abuts the transmitting member to cause the transmitting member to pivot to the non-transmission position.

4. A sewing machine according to claim 1, further comprising:

a needle bar having a lower end to which the needle is fixed and moved up and down;

a threading bar having a lower end to which the threading hook is fixed and moved up and down and caused to pivot, the threading bar being disposed in parallel with and near the needle bar; and a rotation imparting member provided on the threading bar to be moved up and down with the threading bar, the rotation imparting member being moved up and down thereby to rotate the threading bar stopped at a lowermost position, wherein the actuating member is moved up and down, and the transmitting member is moved up and down together with the actuating member and caused to pivot about a pivot axis perpendicular to a direction in which the actuating member is moved up and down, thereby being moved between the transmission position and the non-transmission position, wherein the transmitting member abuts the rotation imparting member to transmit a downward movement of the actuating member to the rotation imparting member when assuming the transmission position; and wherein the transmitting member is spaced away from the rotation imparting member when assuming the non-transmission position.

5. A threading method for a sewing machine including a threading hook passed through the eye of the needle, an urging member for urging the threading hook toward a position away from the eye of the needle, an actuating member for advancing the threading hook through an eye of a needle against an urging force of the urging member, a transmitting member for transmitting an operation of the actuating member to the threading hook, and a thread holding member for holding a thread, the threading method comprising:

transmitting the operation of the actuating member to the threading hook by the transmitting member;

advancing the threading hook through the eye of the needle;

moving the thread holding member to a position where the thread held by the thread holding member is located near the threading hook having been advanced through the eye of the needle; and interrupting transmission of the operation of the actuating member by the transmitting member and returning the threading hook to the position away from the eye of the needle by the urging member.

6. A sewing machine comprising:

a needle bar moved up and down and having a lower end;

a sewing needle fixed to the lower end of the needle bar;

a threading mechanism including a threading bar provided near the needle bar to be movable up and down and rotatable, the threading bar having a lower end, threading hook fixed to the lower end of the threading bar and advanced through the eye of the needle and an urging member for urging the threading hook toward a position away from the eye of the needle, the threading mechanism rotating the threading bar against an urging force of the urging member after the threading bar has been moved to a position where the threading hook is allowed to be advanced through the eye of the needle, thereby advancing the threading hook through the eye of the needle;

an actuating member for actuating the threading mechanism;

a transmitting mechanism for transmitting an operation of the actuating member via the threading bar to the threading mechanism; and interrupting mechanism for interrupting the transmission of the operation of the actuating member by the transmitting mechanism after advancement of the threading hook through the eye of the needle has been completed, whereby the threading hook is returned to the position away from the eye of the needle by the urging force of the urging member.

7. A sewing machine according to claim 6, wherein the transmitting mechanism includes a transmitting member moved between a transmission position where an operation of the actuating member is transmitted to the threading hook and a non-transmission position where an operation of the actuating member is not transmitted to the threading hook, and the interrupting mechanism includes an abutting member abutting the transmitting member to move the transmitting member from the transmission position to the non-transmission position after advancement of the threading hook through the eye of the needle has been completed, whereby the transmission of the operation of the actuating member by the transmitting mechanism is interrupted.

8. A sewing machine according to claim 7, further comprising a sewing machine frame, wherein the abutting member is provided on the sewing machine frame.

9. A sewing machine according to claim 7, wherein the transmitting member is caused to pivot thereby moving between the transmission position and the non-transmission position, and the abutting member abuts the transmitting member to cause the transmitting member to pivot to the non-transmission position.

* * * * *